United States Patent [19]

Habich et al.

[11] 4,330,218

[45] * May 18, 1982

[54] APPARATUS FOR CONNECTING AND DISCONNECTING A MOTOR AND A PRINT ELEMENT BY PIVOTING A RIBBON CARTRIDGE

[75] Inventors: Adolph B. Habich; Ronald E. Hunt, both of Austin, Tex.

[73] Assignee: International Business Machines Corporation, Armonk, N.Y.

[ * ] Notice: The portion of the term of this patent subsequent to Jul. 14, 1998, has been disclaimed.

[21] Appl. No.: 53,648

[22] Filed: Jun. 29, 1979

[51] Int. Cl.[3] ..... B41J 1/30

[52] U.S. Cl. ..... 400/144.2; 400/55; 400/59; 400/175; 400/208; 400/434.2

[58] Field of Search ..... 400/144, 144.1, 144.2, 400/144.3, 144.4, 146, 171, 174, 175, 208, 434.2, 59; 101/111

[56] References Cited

U.S. PATENT DOCUMENTS

| | | | |
|---|---|---|---|
| 3,805,697 | 4/1974 | Mahe | 101/111 |
| 3,960,256 | 6/1976 | Bickoff et al. | 400/59 X |
| 3,983,803 | 10/1976 | Thomas et al. | 101/111 X |
| 3,990,563 | 11/1976 | Adamek et al. | 400/208 X |
| 4,020,940 | 5/1977 | Daley et al. | 400/144.2 X |
| 4,049,109 | 9/1977 | Plaza et al. | 400/144.2 X |
| 4,124,312 | 11/1978 | Johnson | 400/144.2 |
| 4,127,335 | 11/1978 | Bogert et al. | 400/175 X |
| 4,134,695 | 1/1979 | Randolph | 400/59 X |
| 4,161,373 | 7/1979 | Chvatlinsky | 400/175 |
| 4,202,639 | 5/1980 | Rello | 400/175 X |

FOREIGN PATENT DOCUMENTS

| | | | |
|---|---|---|---|
| 132477 | 4/1978 | German Democratic Rep. | 400/175 |
| 2022022 | 12/1979 | United Kingdom | 400/144.2 |

OTHER PUBLICATIONS

IBM Technical Disclosure Bulletin, "Impact Printer with Cassette Daisy Wheel Type Font", Roberti et al., vol. 22, No. 1, Jun. 1979, pp. 1–3.

IBM Technical Disclosure Bulletin, "Semiautomatic Print Wheel Loader", Cox et al., vol. 18, No. 10, Mar. 1976, p. 3356.

IBM Technical Disclosure Bulletin, "Automated Printwheel Removal Mechanism", Okcuoglu et al., vol. 22, No. 4, Sep. 1979, pp. 1538–1539.

"IBM Mag Card Adjustment Parts Manual", No. 241–5584–7, Jan. 1979.

"IBM Mag Card Service/Parts Manual", No. 241–59-92–0, Feb. 1978.

*Primary Examiner*—Ernest T. Wright, Jr.

*Attorney, Agent, or Firm*—James H. Barksdale, Jr.

[57] ABSTRACT

A method of, and apparatus for, engaging and disengaging a selection motor drive hub and a daisy wheel print element. Included therein and utilized therefor are means for permitting a pivoting of a ribbon cartridge and means for connecting the ribbon cartridge to a selection motor. The motor and cartridge are connected such that upon a pivoting of the ribbon cartridge for (1) a print element change, the hub is translated out of engagement with the print element, and (2) continued printing, the hub is translated into engagement with the print element.

7 Claims, 2 Drawing Figures

APPARATUS FOR CONNECTING AND DISCONNECTING A MOTOR AND A PRINT ELEMENT BY PIVOTING A RIBBON CARTRIDGE

DESCRIPTION

CROSS-REFERENCES TO RELATED APPLICATIONS

U.S. patent application Ser. No. 053,649, filed June 29, 1979, entitled "Carrier for Print Element And Ribbon Cartridges", and having A. B. Habich and R. E. Hunt as inventors.

U.S. patent application Ser. No. 053,646, filed June 29, 1979, entitled "Daisy Wheel Printer Carrier" and having A. B. Habich and R. E. Hunt as inventors.

U.S. patent application Ser. No. 968,287, filed Nov. 28, 1979, entitled "Font Changing Apparatus For Daisy Wheel Printer", and having A. B. Habich and R. E. Hunt as inventors.

U.S. patent application Ser. No. 968,320, filed Dec. 11, 1978, entitled "Print Package", and having A. B. Habich and R. E. Hunt as inventors.

U.S. patent application Ser. No. 968,321, filed Dec. 11, 1978, entitled "Print Element Cartridge", and having A. B. Habich and R. E. Hunt as inventors.

U.S. patent application Ser. No. 968,322, filed Dec. 11, 1978, entitled "Print Element", and having A. B. Habich and R. E. Hunt as inventors.

BACKGROUND OF THE INVENTION

1. Field of the Invention

This invention generally relates to changing print elements in single element printers. More specifically, this invention deals with repositioning a ribbon cartridge and causing engagement and disengagement of a print element and selection motor to facilitate a print element change.

2. Description of the Prior Art

Any number of single element printers are available in the marketplace today. The most common fall into the golf ball and daisy wheel categories. Typical of the golf ball printers are those utilized in the IBM Mag Card "Selectric"* Typewriter and IBM Mag Card II Typewriter systems. The printers in both of these systems have a carrier carrying a print element which is tiltable and rotatable for printing. The basic distinction between the carriers in the above mentioned systems is that escapement in the first is rack and pawl controlled whereas in the latter escapement is pawl and leadscrew controlled.

*Registered Trademark-International Business Machines Corporation

The print element utilized in both of these printers is sufficiently displaced from the ribbon when the printers are in the idle or off condition to permit a print element change with little difficulty and without affecting the ribbon. Another reason the ribbon need not be displaced or removed for a print element change is the physical size of the print element relative to the unlatching mechanism located on the top thereof.

Somewhat typical of the daisy wheel printers on the market today is that used in the IBM 6240 Mag Card Typewriter system. The printer of this system has a carrier carrying a selection motor and a ribbon cartridge. The selection motor has a hub to which is connected a daisy wheel print element. The print element is rotatable for character selection during printing, and the periphery thereof is located closely adjacent the ribbon when in position for printing.

In this type of printer, a ribbon cartridge and ribbon are often located in an interfering position when a print element change is required. With this being the case, the cartridge and included ribbon must be removed from the carrier for efficiently handling a print element change. Once the ribbon has been removed, the motor must be canted or pivoted up for a change in print elements.

Other prior art related to daisy wheel printers include U.S. patent application Ser. No. 767,250 (now U.S. Pat. No. 4,127,335 to Bogert et al.), filed Feb. 10, 1977, and U.S. Pat. No. 4,124,312 to Johnson. In both of these references, a carrier is disclosed for carrying a daisy wheel print element housed in a cartridge, a ribbon cartridge, and a selection motor.

Not shown or utilized in any of the above-mentioned prior art, is apparatus for permitting a ribbon cartridge to be pivotally displaced to a non-interfering location and at the same time cause disengagement of a selection motor and print element to permit a print element change.

SUMMARY OF THE INVENTION

Both a method and apparatus are provided for facilitating a print element change with a minimum of operator effort. Incorporated into a daisy wheel printer are a selection motor which is translatable toward and away from a print element, a privotable ribbon cartridge, a cam, and a cable connecting the selection motor and ribbon cartridge. The printer has parallel escapement rails extending parallel to a platen and along which a printer carrier for a motor and a cartridge carrier is positionable by a leadscrew. The printer carrier has adjustable eccentric rails which are disposed above and perpendicular to the escapement rails. Both the motor and the cartridge carrier are independently mounted on the eccentric rails, spring biased toward the platen, and translatable along the eccentric rails toward and away from the platen. The cartridge carrier is for carrying both the ribbon cartridge and a print element cartridge. The print element is housed in the print element cartridge and removable therefrom from the bottom.

The print element cartridge is carried in a receptacle in the front of the cartridge carrier. The receptacle is vertically oriented, perpendicular to a plane extending through the escapement rails, and located adjacent the platen. The ribbon cartridge is pivotally carried on the top rear of the cartridge carrier and is horizontally disposed above the motor during printing. The cable connecting the motor and ribbon cartridge is routed around a tongue on the rear of the cartridge carrier and a cam on the bottom rear of the ribbon cartridge. Upon a pivoting of the ribbon cartridge toward a vertical position, the cable and cam cause the motor to be translated away from the platen. Upon a pivoting of the ribbon cartridge toward a horizontal position over the motor, the motor is permitted to be translated toward the platen under the influence of the spring biasing.

DESCRIPTION OF THE PREFERRED EMBODIMENT

Figure 1:
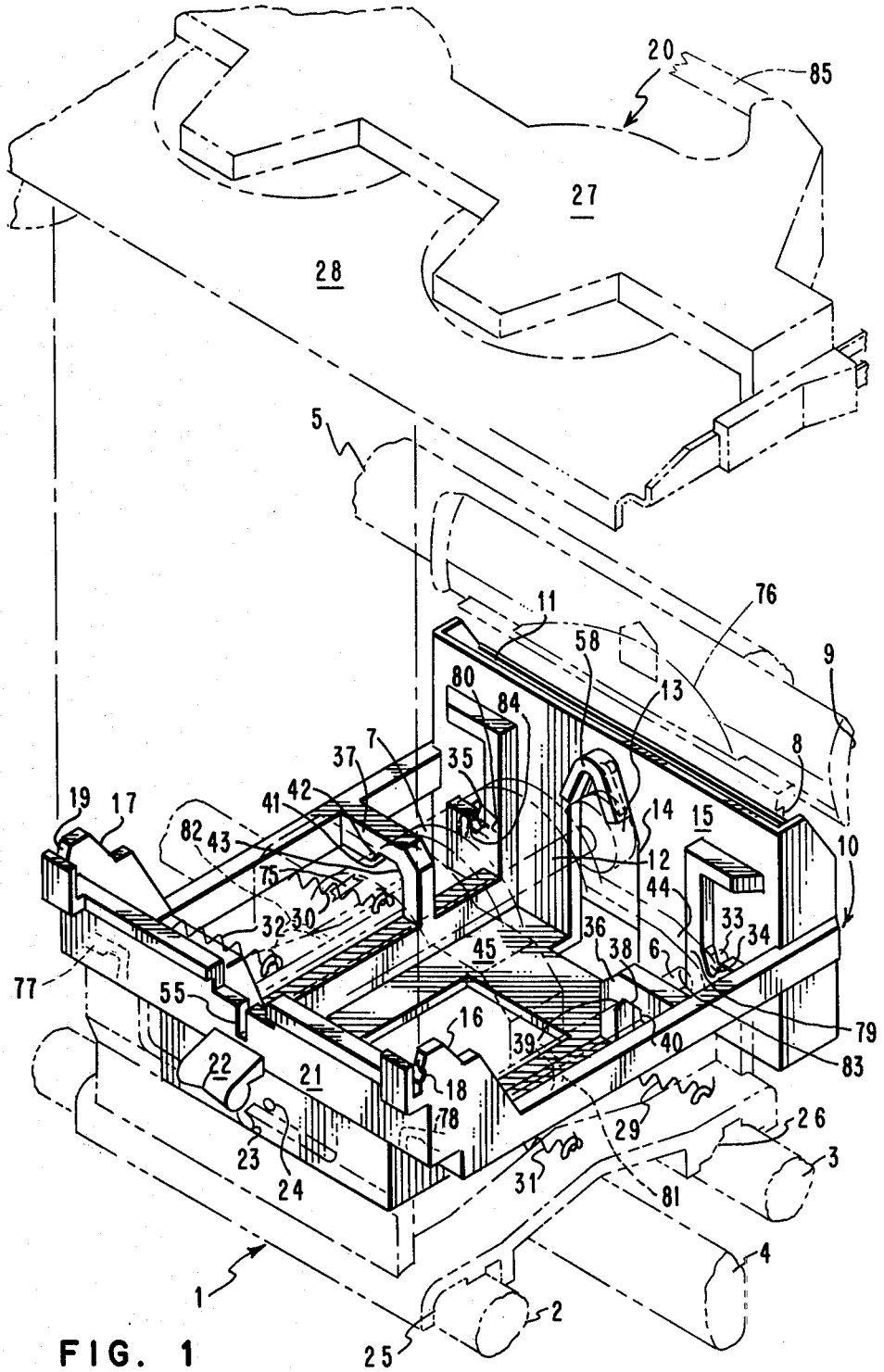
FIG. 1 is a perspective view illustrating the apparatus included in, and utilized according to, this invention.

For a more detailed understanding of the invention, reference is first made to FIG. 1. In this figure is shown a printer carrier for a selection motor and a cartridge carrier. The printer carrier is generally designated by reference numeral 1. Carrier 1 is mountable upon escapement rails 2 and 3 and translated along a platen 5 by a leadscrew 4. Carrier 1 has mounting channels 25 and 26 for accepting escapement rails 2 and 3. Escapement rails 2 and 3, leadscrew 4 and platen 5 extend parallel to one another.

Mountable upon carrier 1 and forming a part thereof is an eccentric rail 6. Located on the opposite side of carrier 1 is another eccentric rail 75. The eccentric rails 6 and 75 are for carrying a selection motor 7 and a carrier for carrying a ribbon cartridge mechanism 20 and a print element cartridge 8. The cartridge carrier is generally designated by reference numeral 10. The eccentric rails 6 and 75 are parallel to one another, disposed above escapement rails 2 and 3, and positioned perpendicularly to rails 2 and 3. Both motor 7 and carrier 10 are translatable or slidable in the same direction along the eccentric rails 6 and 75 toward and away from platen 5.

Carrier 10 has a vertically oriented print element cartridge receptacle 11 mounted on the front thereof for carrying print element cartridge 8. Receptacle 11 is oriented perpendicular to a plane passing through rails 2 and 3. Cartridge 8 has an integral cardholder 9. A shaft 12 of selection motor 7 has a drive hub 13 for engaging a daisy wheel print element 76 when positioned within cartridge 8 during printing. Drive hub 13 is translatable through an opening 14 in back 15 of receptacle 11 upon translation of motor 7.

On the top rear of carrier 10 are supports 16 and 17 having recesses 18 and 19 therein. Recesses 18 and 19 are for accepting a rod 49 (FIG. 2) for carrying a ribbon cartridge mechanism generally designated by reference numeral 20. Recess 18 and 19 and rod 49 will be discussed further later herein. Ribbon cartridge mechanism 20 is made up of a ribbon spool housing 27 and a plate 28 for carrying housing 27.

Both motor 7 and carrier 10 are spring biased toward platen 5 and downwardly by motor springs 29 and 30 and carrier springs 31 and 32.

Referring again to the eccentric rail 6, there is a front end 33 of relatively small diameter. On the rear end of rail 6 is similar end 47 (FIG. 2) of small diameter. Ends 33 and 47 have a common axis of rotation which is offset from the axis of rotation of the remainder of rail 6.

End 33 is positioned in a "V" groove 34 in carrier 1. On the opposite side of carrier 1 is a similar "V" groove 35 for accepting the end of eccentric rail 75.

Carrier 10 has a plurality of mounting brackets such as 36 and 37. Mounting bracket 36 has a mounting recess having a top 38 and beveled or angularly projecting surfaces 39 and 40. Surfaces 39 and 40 are spaced so as to be in contact with eccentric rail 6 at all times.

In like manner, mounting bracket 37 has a mounting recess having a top 41 and beveled surfaces 42 and 43. The difference between the mounting recesses in brackets 36 and 37 is that the beveled surfaces 42 and 43 are spaced further apart in bracket 37. This is to permit rotation of eccentric rails 6 and 75 with beveled surfaces 39 and 40 and top surface 41 always in contact with rail 75. Also, carrier 10 has mounting brackets 77 and 78 similar to 36 and 37 disposed beneath back 21. Motor 7 has a front motor mount 44 having mounting brackets 79 and 80 with recesses 83 and 84 therein similar to those in mounting brackets 36 and 37. Motor 7 also has a rear motor mount 45 which is similar to mount 44, and has mounting brackets 81 and 82.

Upon rotation of the eccentric rails 6 and 75, motor 7 and carrier 10 are oriented relative to platen 5. Orientation can be in terms of a side-to-side canting of carrier 10 upon different extents of rotation of the eccentric rails 6 and 75. Orientation can also be vertical upon equal extents of rotation of the eccentric rails 6 and 75.

Figure 2:
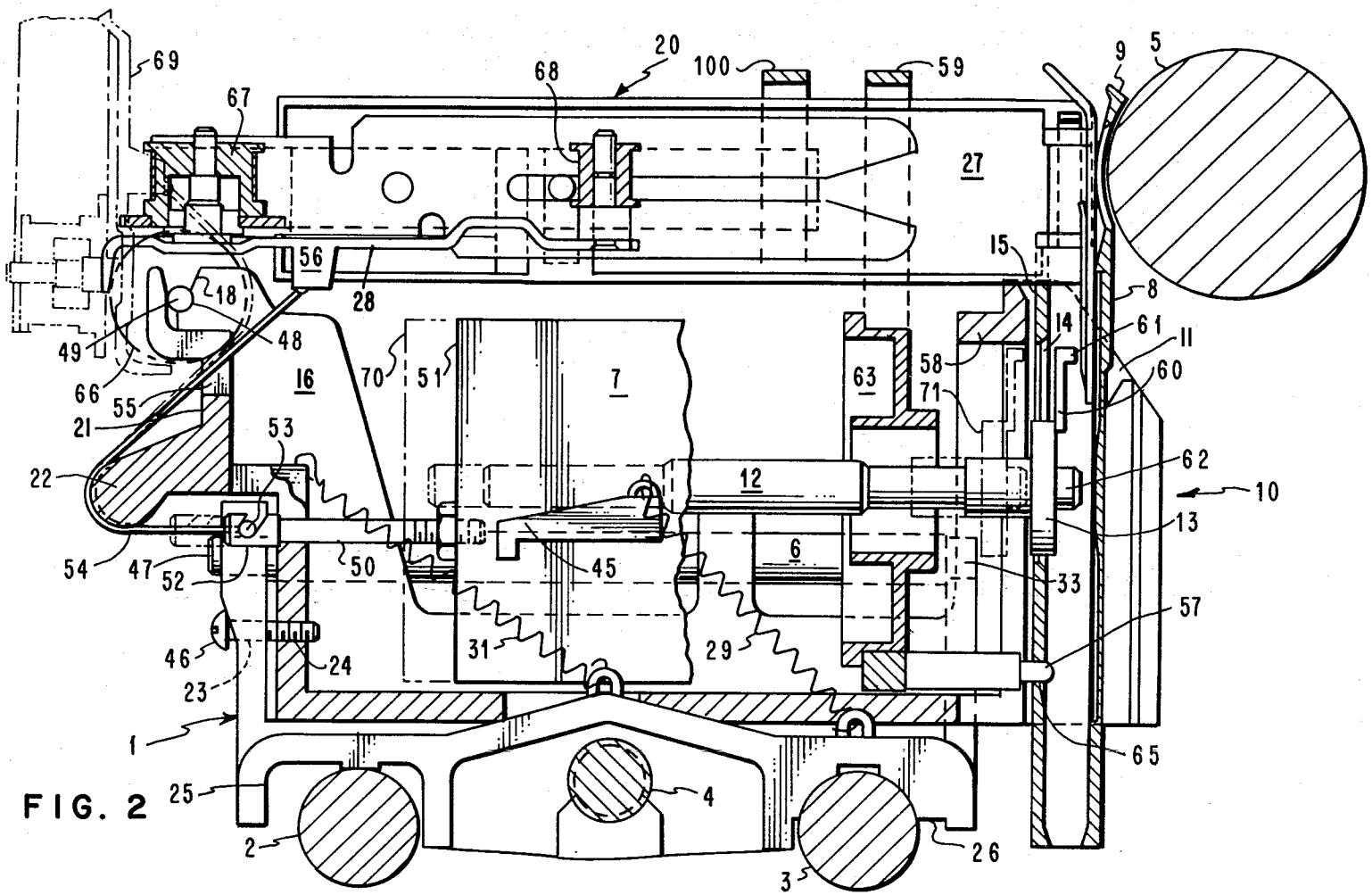
FIG. 2 is a side view of the apparatus illustrated in FIG. 1.

Reference is next made to FIG. 2 in conjunction with FIG. 1. On the back 21 of carrier 10 is a tongue 22. Positioned below tongue 22 on carrier 10 is an opening 24 which is aligned with an opening 23 in carrier 1. Threadably secured in opening 24 in carrier 10 is a screw 46. Screw 46 is freely positioned in opening 23 in carrier 1. Screw 46 is for positioning carrier 10 on the eccentric rails 6 and 75 relative to carrier 1.

Within recesses 18 and 19 in supports 16 and 17 are cylindrical portions or detents such as detent 48 in recess 18. Detent 48 is for accepting rod 49 about which ribbon cartridge mechanism 20 is pivotable.

Cartridge mechanism 20 is pivotable between a horizontal position shown in solid lines and a vertical dotted line position 69. A number of guide or drive spools are carried by ribbon cartridge mechanism 20 such as those indicated by reference numerals 67 and 68.

Connected to the back 51 of motor 7 is an anchor bolt 50. Bolt 50 has a cable hook 52 on the left end thereof. Cable hook 52 is for accepting a retaining bob 53 connected to a cable 54. Cable 54 is routed around tongue 22, through slot 55 in carrier 10, and connected to protuberance 56 on the bottom of ribbon cartridge mechanism 20. Positioned in communicating relationship with cable 54 is a cam 66. Cam 66 is secured to the bottom left end of ribbon cartridge mechanism 20 in FIG. 2. Both cam 66 and cartridge mechanism 20 are pivotable about rod 49. Tongue 22 maintains cable 54 extended and away from cam 66 when cartridge mechanism 20 is in the horizontal position. When cartridge mechanism 20 is pivoted to a vertical position, cable 54 will be partially wrapped on, and extend past cam 66.

When cartridge mechanism 20 is in a horizontal position, a ribbon 85 carried thereby is located behind the cardholder 9 and in a position for printing. As such, both the ribbon 85 and cartridge mechanism 20 are in an interfering position for a print element change, printer servicing, etc.

When it is desired to pivot cartridge mechanism 20 from a horizontal position to vertical position 69 in order to either remove print element cartridge 8 from receptacle 11 and/or install another cartridge 8 in receptacle 11, a latch 100 is operated. Latch 100 can be an "L" shaped leafspring secured to the housing for motor 7. Located to the right of latch 100 is a print hammer mounting bracket 59. Bracket 59 is connected to a front housing 63 for motor 7.

As pointed out above, upon a pivoting of cartridge mechanism 20 from a horizontal to a vertical position 69, cable 54 will be wrapped around cam 66. Cam 66 will cause motor 7 to be displaced horizontally to the left to a dotted line position 70. This displacement of motor 7 results in drive hub 13, which is connected to selection motor shaft 12, being displaced to the left to the dotted line position 71. Anchor bolt 50 is adjustable in back 51 to control the location of motor 7 while in the print position relative to the platen 5. Upon displacement of hub 13 to the left, there is a disengagement of hub 13 and a daisy wheel print element 76 housed in cartridge 8. Drive hub 13 is secured to end 62 of shaft 12 and has an extension 60 carrying an offset drive pin 61. During displacement of drive hub 13 and motor 7 upon a pivoting of cartridge mechanism 20, it is desirable that drive hub 13 be maintained in a home position. A dormer 58 serves this purpose.

Front motor mount 44 is carried by front motor housing 63. Location pin 57 is in turn connected to front motor mount 44. Location pin 57 is for positionally maintaining cartridge 8 in receptacle 11. Pin 57 communicates with an opening 65 in cartridge 8. Following either a removal of cartridge 8 from, and/or insertion of another print element cartridge 8 into, receptacle 11, cartridge mechanism 20 is pivoted back to the horizontal position. This results in motor 7 being permitted to translate from the dotted line position 70 to the solid line position. Translation of motor 7 is under the influence of springs 29 and 30. Upon a translation of motor 7 to the right, pin 57 is inserted into opening 65 to locate and maintain cartridge 8.

In summary, both a method and apparatus are provided for facilitating a print element change with a minimum of operator effort. Incorporated into a daisy wheel printer are a selection motor which is translatable toward and away from a print element, a pivotable ribbon cartridge, a cam, and a cable connecting the selection motor and ribbon cartridge. The printer has parallel escapement rails extending parallel to a platen and along which a printer carrier for a motor and a cartridge carrier is positionable by a lead-screw. The printer carrier has adjustable eccentric rails which are disposed above and perpendicular to the escapement rails. Both the motor and the cartridge carrier are independently mounted on the eccentric rails, spring biased toward the platen, and translatable along the eccentric rails toward and away from the platen. The cartridge carrier is for carrying both the ribbon cartridge and a print element cartridge. The print element is housed in the print element cartridge and removable therefrom from the bottom.

The print element cartridge is carried in a receptacle in the front of the cartridge carrier. The receptacle is vertically oriented, perpendicular to a plane extending through the escapement rails, and located adjacent the platen. The ribbon cartridge is pivotally carried on the top rear of the cartridge carrier and is horizontally disposed above the motor during printing. The cable connecting the motor and ribbon cartridge is routed around a tongue on the rear of the cartridge carrier and a cam on the bottom rear of the ribbon cartridge. Upon a pivoting of the ribbon cartridge toward a vertical position, the cable and cam cause the motor to be translated away from the platen. Upon a pivoting of the ribbon cartridge toward a horizontal position over the motor, the motor is permitted to be translated toward the platen under the influence of the spring biasing.

While the invention has been particularly shown and described with reference to a preferred embodiment it will be understood by those skilled in the art that various other changes in form and detail may be made without departing from the spirit and scope of the invention.

What is claimed is:

1. Apparatus for engaging and disengaging a selection motor drive hub and a daisy wheel print element upon pivoting of a ribbon cartridge during a print element chage operation, for printer servicing, etc., said apparatus comprising in combination:

(a) means for supporting said ribbon cartridge for pivoting between positions such that an included ribbon is (1) out of interfering relationship with said print element, and (2) in printing relationship with said print element;

(b) means for supporting said means for supporting said ribbon cartridge and a selection motor having said hub connected thereto for independent translation in the same direction toward and away from said print element, said selection motor being translatable for causing engagement and disengagement of said hub and said print element; and (c) means for connecting said selection motor and said ribbon cartridge for causing said hub to be translated toward and away from said print element upon a pivoting of said ribbon cartridge for positioning said ribbon in printing relationship and non-interfering relationship with said print element.

2. Apparatus according to claim 1 including a projection associated with said ribbon cartridge supporting means and past which said connecting means extends.

3. Apparatus according to claim 2 including cam means associated with said ribbon cartridge and past which said connecting means extends for causing disengagement of said hub and said print element when said ribbon cartridge is pivoted to position said ribbon in non-interfering relationship with said print element.

4. Apparatus according to claim 3 including means connected to said connecting means for adjusting the extent of translation of said selection motor upon a pivoting of said ribbon cartridge.

5. Apparatus for causing engagement and disengagement of a selection motor and a print element upon a pivoting of a ribbon cartridge, said apparatus comprising:

(a) a cable connected to said ribbon cartridge and said selection motor; and (b) a cam means connected to said ribbon cartridge and past which said cable extends when said selection motor and said print element are not in engagement.

6. Apparatus according to claim 5 including a projecting means for maintaining said cable away from said cam means when said print element and said selection motor are in engagement.

7. Apparatus according to claim 6 including means for adjusting said selection motor relative to a platen.

* * * * *